US007362277B2

(12) United States Patent
Su

(10) Patent No.: US 7,362,277 B2
(45) Date of Patent: Apr. 22, 2008

(54) MULTI-BAND ANTENNA

(75) Inventor: Wen-Fong Su, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/599,659

(22) Filed: Nov. 14, 2006

(65) Prior Publication Data

US 2007/0109200 A1 May 17, 2007

(30) Foreign Application Priority Data

Nov. 14, 2005 (TW) ..... 94139847 A

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/700 MS, 343/702, 846, 829, 830
See application file for complete search history.

(56) References Cited

U.S. PATENT DOCUMENTS

| | | | | |
|---|---|---|---|---|
| 6,812,892 | B2 * | 11/2004 | Tai et al. | 343/700 MS |
| 6,861,986 | B2 | 3/2005 | Fang | |
| 6,864,854 | B2 * | 3/2005 | Dai et al. | 343/846 |
| 2005/0073462 | A1 * | 4/2005 | Lin et al. | 343/702 |
| 2005/0168384 | A1 * | 8/2005 | Wang et al. | 343/700 MS |
| 2005/0259024 | A1 * | 11/2005 | Hung et al. | 343/770 |

* cited by examiner

*Primary Examiner*—Hoang V Nguyen
(74) *Attorney, Agent, or Firm*—Wei Te Chung

(57) ABSTRACT

A multi-band antenna used in an electronic device, including a radiating element, a grounding element, a connecting element connecting the radiating element and the grounding element, a feeding cap, and an installing element. The feeding cap locates at the feeding point according to calculation. An inner conductor of a feeding line (no shown) of the multi-band antenna in accordance with the present invention is capable of being soldered inerrably at the feeding cap, accordingly, the multi-band antenna can achieve a good performance of operation.

19 Claims, 2 Drawing Sheets

MULTI-BAND ANTENNA

BACKGROUND OF THE INVENTION

The present invention has referred a Disclosure Document No. 583370 on Aug. 4, 2005.

1. Field of the Invention

The present invention relates generally to an antenna, and more particularly to a multi-band antenna used in a portable electronic device.

2. Description of the Prior Art

With the development of wireless communication, more and more portable electronic devices, such as a notebook, install an antenna system for working in a Wireless Local-area Network (WLAN). Transmitting and receiving signals plays an important role in wireless communication process. In recent years, a majority of WLAN bases on Bluetooth technical standard or 802.11 technical standard. Antenna in Bluetooth technical standard is based on 2.4 GHz frequency band, and in 802.11 technical standard is based on 2.4 GHz and 5 GHz. So, antenna in notebook mostly works at the above frequency bands at the present time.

PIFA (Planar Inverted-F Antenna) is a kind of minitype antenna usually used in the portable electronic devices. PIFA has compact structure, light weight, perfect impedance match, desired horizontal polarization and vertical polarization, and is easy to achieve multi-band. So, more and more PIFAs are used in the portable electronic devices.

However, the feeding point of an ordinary PIFA is difficult to achieve. In other words, the feeding line of the PIFA is difficult to be soldered at the feeding point according to calculation. For example, U.S. Pat. No. 6,861,986 B2 discloses a PIFA comprising a radiating element, a connecting element, a grounding element, a feeding point on the connecting element and a feeding line. The feeding line of the PIFA is difficult to be soldered at the feeding point according to calculation because there is no mark on the location of the feeding point on the connecting element, thus, the accurate soldering between the feeding line and the PIFA is hard to achieve. Accordingly, the input impedance of the PIFA is likely to do not match with the impedance of the feeding line.

Hence, in this art, a multi-band antenna to overcome the above-mentioned disadvantages of the prior art will be described in detail in the following embodiment.

BRIEF SUMMARY OF THE INVENTION

A primary object, therefore, of the present invention is to provide a multi-band antenna with a feeding cap for soldering a feeding line thereon.

In order to implement the above object and overcome the above-identified deficiencies in the prior art, a multi-band antenna formed in a metal patch, comprises a grounding element, a radiating element, a connecting element connecting the radiating element and the grounding element; and a feeding cap being a protruding metal extending vertically from the radiating element or a joint of the radiating element and the connector element and locating at a position of the feeding point according to calculate.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
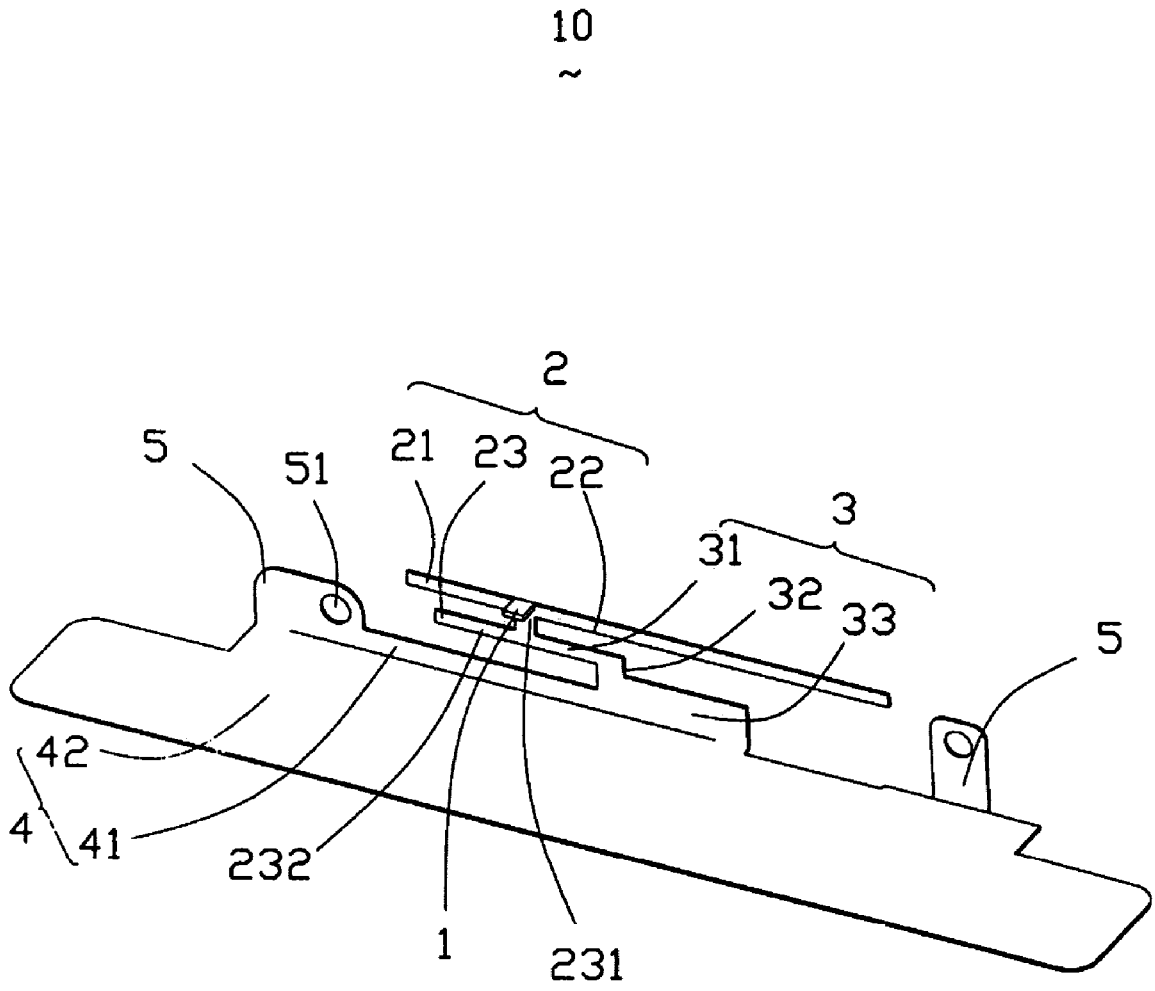
FIG. 1 is a perspective view of a preferred embodiment of a multi-band antenna in accordance with the present invention.

Referring to FIG. 1, a multi-band antenna 10 according to the preferred embodiment of the present invention is made of a metal patch. The multi-band antenna 10 comprises a radiating element 2, a grounding element 4, a connecting element 3 connecting the radiating element 2 and the grounding element 4, a feeding cap 1, and a pair of installing elements 5.

The radiating element 2 comprises a first radiating section 21 operating at a higher frequency, a second radiating section 22 operating at a lower frequency with longer length than that of the first radiating section 21, and an L-shape third radiating section 23 enhancing the higher frequency. The first radiating section 21 and the second radiating section 22 connect each other and extend along a longitudinal direction. The third radiating section 23 comprises a first radiating arm 231 extending vertically from the joint of the first radiating section 21 and the second radiating section 22 and a second radiating arm 232 extending vertically from the first radiating arm 231. The first radiating section 21 and the second radiating arm 232 are parallel to each other and locate at common side of the first radiating arm 231.

The grounding element 4 comprises a first grounding section 41 coplanar with the radiating element 2 and a bigger second grounding section 42 extending vertically from the first grounding section 41.

The connecting element 3 is Z-shape and coplanar with the radiating element 2 and the first grounding section 41 and comprises a first part 31 extending from the joint of the first radiating arm 231 and the second radiating arm 232, a third part 33 connecting to the first grounding section 41, and a second part 32 connecting the first part 31 and the third part 33.

The feeding cap 1 is a protruding rectangular metal is perpendicular to the plane in which the radiating element 2 and extends outwardly from an upper edge of the joint of the first radiating section 21, the second radiating section 22, and the third radiating section 23. The feeding cap 1 locates at a position of the feeding point according to calculation and the location thereof is immovable. A feeding line of an ordinary antenna is difficult to solder at the feeding point of the calculation, and any weak excursion can make the input impedance being not match with the impedance of the feeding line. A feeding line (no shown) comprising an inner conductor and a shielding braid of the multi-band antenna 10 in accordance with the present invention is capable of soldering inerrably at the feeding point according to calculation, accordingly, the multi-band antenna 10 can achieve a good performance of operation. The shielding braid is capable soldering to the first grounding section 41 or the second grounding section 42.

The pair of installing elements 5, the radiating element 2, and the first grounding section 41 are coplanar. The pair of installing elements 5 extend vertically from the two ends of the second grounding section 42 along an upwards direction. Each installing element 5 has a circular hole 51 for permitting a screw protruding though to fasten the multi-band antenna 10 onto the portable electrical device.

Figure 2:
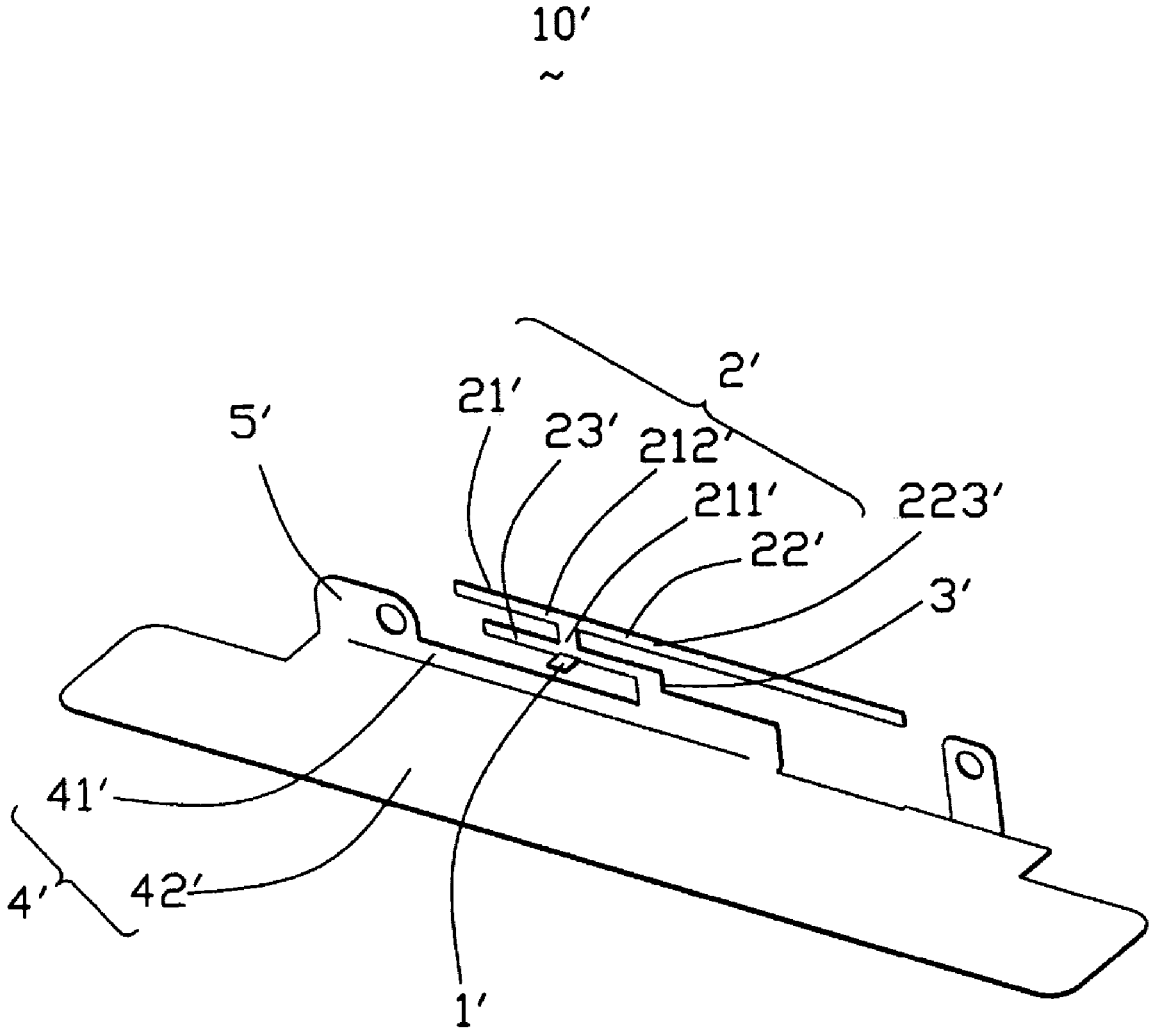
FIG. 2 is a perspective view of a second embodiment of a multi-band antenna in accordance with the present invention.

Referring to FIG. 2, a multi-band antenna 10' according to the second embodiment of the present invention is made of a metal patch. The multi-band antenna 10' comprises a radiating element 2', a grounding element 4', a connecting element 3' connecting the radiating element 2' and the grounding element 4', a feeding cap 1', and a pair of installing elements 5'. The multi-band antenna 10' has the substantially same structure as that of multi-band antenna 10, except the location of the feeding cap 1' is different from that of feeding cap 1. Thus, the definition of the elements is altered. Detailed descriptions are given below.

The radiating element 2' comprises an L-shape first radiating section 21' operating at a higher frequency, an L-shape second radiating section 22' operating at a lower frequency, and a flat third radiating section 23' enhancing the higher frequency. The first radiating section 21' comprises a first radiating branch 211' and a second radiating branch 212' perpendicular to the first radiating branch 211'. The second radiating section 22' comprises the common first radiating branch 211' and a third radiating branch 223' extending along a direction reverse to the second radiating branch 212'. The third radiating section 23' extends vertically from the first radiating branch 211'. The third radiating section 23' and the second radiating branch 212' are parallel to each other and locate at common side of the first radiating branch 211'.

The grounding element 4' comprises a first grounding section 41' coplanar with the radiating element 2' and a bigger second grounding section 42' extending vertically from the first grounding section 41'.

The connecting element 3' is Z-shape and has the substantially same structure as that of 3.

The feeding cap 1' is a protruding rectangular metal is perpendicular to the plane in which the radiating element 2' and extends outwardly from an upper edge of the joint of the third radiating section 23', the first radiating branch 211', and the connecting section 3'. The feeding cap 1' locates at a position of the feeding point according to calculation and the location thereof is immovable. A feeding line of an ordinary antenna is difficult to solder at the feeding point according to calculation, and any weak excursion can make the input impedance being not match with the impedance of the feeding line. A feeding line (no shown) comprising an inner conductor of the multi-band antenna 10' in accordance with the present invention is capable of soldering inerrably at the feeding point according to calculation, accordingly, the multi-band antenna 10' can achieve a good performance of operation.

The pair of installing elements 5', the radiating element 2', and the first grounding section 41' are coplanar. The pair of installing elements 5' has the substantially same structure as that of the pair of installing elements 5.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna adapted for used in a portable electronic device, comprising:

a grounding element;

a radiating element;

a feeding point according to calculation being provided with the radiating element;

a connecting element connecting the radiating element and the grounding element;

a feeding cap protruding perpendicularly from the radiating element and locating at a position of the feeding point according to calculation; and a feeding line comprising an inner conductor soldered with the feeding cap and a shielding braid soldered with the grounding element.

2. The antenna as claimed in claim 1, wherein the antenna is a multi-band antenna capable of operating at a higher frequency and a lower frequency.

3. The antenna as claimed in claim 1, wherein the radiating element comprises a first radiating section operating at a higher frequency and a second radiating section operating at a lower frequency extending in a longitudinal direction.

4. The antenna as claimed in claim 3, wherein the radiating element comprises a third radiating section comprising a first radiating arm and a second radiating arm, the first radiating arm extending vertically from the joint of the first radiating section and the second radiating section, the second radiating arm extending vertically from the first radiating arm to be parallel to the first and second radiating sections.

5. The antenna as claimed in claim 4, wherein the feeding cap is rectangle metal and locates at a joint of the first radiating section, the second radiating section, and the first radiating arm of the third radiating section.

6. The antenna as claimed in claim 1, wherein the radiating element comprises a first radiating section, a second radiating section, and a third radiating section; the first radiating section and the second radiating section are L-shape and have a common first radiating branch.

7. The antenna as claimed in claim 6, wherein the first radiating section comprises a second radiating branch perpendicular to the first radiating branch, the second radiating section comprises a third radiating branch perpendicular to the first radiating branch, the second radiating branch -and the third radiating branch extends along a longitudinal direction.

8. The antenna as claimed in claim 6, wherein the feeding cap is rectangle metal and locates at a joint of the first radiating branch, the third radiating section, and the connecting element.

9. The antenna as claimed in claim 6, wherein the third radiating section is parallel to the second radiating branch of the first radiating section.

10. An antenna adapted for used in a portable electronic device, comprising:

a grounding element;

a radiating element;

a connecting element connecting the radiating element and the grounding element;

a feeding cap protruding vertically from a joint of the radiating element and the connecting element and locating at a position of the feeding point according to calculation; and a feeding line comprising an inner conductor soldered with the feeding cap and a shielding braid soldered with the grounding element.

11. The antenna as claimed in claim 10, wherein the antenna is a multi-band antenna capable of operating at a higher frequency and a lower frequency.

12. The antenna as claimed in claim 10, wherein the radiating element comprises a first L-shape radiating section, a second L-shape radiating section, and a third radiating section.

13. The antenna as claimed in claim 12, wherein the first radiating section and the second radiating section have a common first radiating branch.

14. The antenna as claimed in claim 13, wherein the first radiating section comprises a second radiating branch perpendicularity to the first radiating branch, the second radiating section comprises a third radiating branch perpendicularity to the first radiating branch, the second radiating branch and the third radiating branch extend along a longitudinal direction.

15. The antenna as claimed in claim 14, wherein the radiating element comprises a third radiating section extending vertically from the first radiating branch.

16. The antenna as claimed in claim 15, wherein the feeding cap locates at a joint of the first radiating branch, the third radiating section, and the connecting element.

17. A three-band antenna adapted for used in a portable electronic device, comprising:

a grounding element;

a radiating element including at least three radiating segments located at at least two upper and lower levels;

a feeding point according to calculation being provided with the radiating element;

a connecting element connecting the radiating element and the grounding element;

a feeding cap protruding from the radiating element and locating at a position of the feeding point according to calculation; and a feeding line comprising an inner conductor soldered with the feeding cap and a shielding braid soldered with the grounding element.

18. The antenna as claimed in claim 17, wherein the connecting element is connected to the radiating element at the lower level.

19. The antenna as claimed in claim 18, wherein the feeding cap is located at either the lower level or the upper level.

* * * * *